US005209023A

United States Patent [19]

Bizer

[11] Patent Number: 5,209,023

[45] Date of Patent: May 11, 1993

[54] THERMOPLASTIC POLYMER OPTICAL LAP AND METHOD OF MAKING SAME

[76] Inventor: Jerry Bizer, 516 East Hwy. 131, Clarksville, Ind. 47130

[21] Appl. No.: 525,449

[22] Filed: May 18, 1990

[51] Int. Cl.[5] ..... B23F 23/00

[52] U.S. Cl. ..... 51/209 R; 51/209 DL; 51/206 NF; 51/DIG. 6

[58] Field of Search ..... 51/209 R, 209 DL, 206 NF, 51/DIG. 6, 284 R, 204, 206.4

[56] References Cited

U.S. PATENT DOCUMENTS 2,426,215 8/1947 Hicks .
2,434,614 1/1948 Hicks .
3,225,497 12/1965 Brandt ..... 51/284 R
3,685,214 8/1972 Sarofeen ..... 51/209 DL
4,035,160 7/1977 Taguchi .
4,042,346 8/1977 Sioui et al. .
4,088,729 5/1978 Sherman .
4,106,915 8/1978 Kagawa et al. .
4,212,136 7/1980 Stertzbach ..... 51/204 R
4,212,137 7/1980 Rue ..... 51/206.4
4,382,803 5/1983 Allard .
4,541,843 9/1985 Elbel et al. .
4,821,461 4/1989 Holmstrand .

*Primary Examiner*—M. Rachuba
*Attorney, Agent, or Firm*—Middleton & Reutlinger

[57] ABSTRACT

An optical polishing lap is molded of a thermoplastic polymer containing a particulate-mineral-reinforced polyamide resin in a one-piece construction. The lap has a base portion which construction allows the lap to be mounted to any one of a lap cutter, a lap grinder, or a lap polishing machine, without the use of adapters.

12 Claims, 1 Drawing Sheet

THERMOPLASTIC POLYMER OPTICAL LAP AND METHOD OF MAKING SAME

FIELD OF THE INVENTION

This invention relates to optical grinding "laps", particularly to an optical grinding lap comprised of an easily machinable (and re-machineable) thermoplastic polymer.

BACKGROUND OF THE INVENTION

In preparing and grinding optical lenses, for example eyeglass lenses, the primary grinding (i.e., the grinding necessary to put the primary focal or optical curvature into the lens(es) according to the eye doctor's prescription) is performed by relatively coarse abrasive materials. The result is that, after the optical curvature is ground into the lens(es), the inside (i.e., interior, concave) surface of the lens is almost opaque from grinding or scratch marks left by the optical grinding cutters.

The prevailing practice in the optometry field is to perform a "secondary" grinding or polishing operation upon those concave surfaces, to remove the grinding lines left by the primary optical cutters. This secondary polishing operation may itself comprise more than one step, but both steps are performed in substantially the same manner. Basically, the eyeglass lens is placed "scratched" (i.e., concave) side down upon a polishing "lap" or, as they are sometimes referred to, polishing master. The receiving surface of the polishing lap is convex, and is usually ground to the exact reciprocal of the concave surface of the lens, so there is virtually complete surface mating between the concave surface of the lens to be polished, and the convex surface of the lap upon which the polishing is to be accomplished.

Before the lens is placed upon the lap for polishing, the lap is provided with an abrasive polishing surface, usually in the form of a flexible adhesive-backed abrasive pad, whereby the abrasive pad is flexible enough to conform fully to the surface of the lap. The lens to be polished is impressed upon the lap (with adhesive pad thereon) in such a way that the surface of the lens to be ground is in full contact with the polishing pad upon the lap.

The combined lens-lap-pad is placed onto a polishing machine and the assembly is caused to oscillated or vibrated in the presence of a polishing lubricant and in such a way that the polishing pad and lubricant removes the grinding marks left by the primary optical cutters. Often the polishing is accomplished in conjunction with providing some sort of a mildly abrasive slurry, of approximately the same grit as is applied to the polishing pad, to the lap-pad-lens assembly while the polishing is taking place.

In two stage polishing processes, such as the polishing process utilized by this inventor, after the slurry polishing step is completed, the first polishing pad is removed, and a second, finer (i.e., less gritty, less abrasive) pad is placed upon the lap. the lens reimpressed thereupon, and the lap-pad-lens assembly is reoscillated/vibrated, this time usually with only water as the provided solution (although other solvents, even including a minor grit solvent, could be used).

It is generally known and appreciated that the laps must be contoured very precisely, to the inverse curvature of the optometric prescription, so the convex surface of the lap will coincide exactly with the concave surface of the optical lens being polished. This is accomplished on commercial lap cutters which are generally known in the art.

Because of the relatively high cost of machining and the time it takes to machine present laps, laps are presently provided in large number of different starting shapes (as many as 72 lap shapes), shapes which are provided in an estimate of the final ground contour, so as to minimize the amount of lap material which must be machined off to exactly match the prescription contour In addition, often it is necessary to have more than one set of laps for each pair of glasses, one set for glass lenses, and a second set for plastic lenses. As you might imagine, the inventory of laps in many optical labs is very high.

In addition, even though presently available laps are made of relatively machineable metal (i.e., aluminum; see infra), it still consumes quite a bit of time to grind a lap.

The techniques and procedures just above described are well known and understood in the optical grinding art.

The standard lap that is used in the optical lab industry is made of aluminum, which replaced cast iron as the lap of choice some ten years ago. However, even though aluminum laps provided advantages over cast iron laps because of their noncorrosiveness, relative ease of machineablity and relative (i.e., compared to cast iron, at any rate) low weight, the aluminum laps in use today have the nagging disadvantage of high machine time to grind to the reciprocal contour of the prescription (as much as 6–12 minutes per lap), and their still relatively high weight (about 12 ounces) causes wear and tear on the polishing apparatus. In addition, the time delay caused by multiple passes on the lap cutter tempts the operator to try to machine off too much aluminum in a single pass, and this often results in chipping of the aluminum, commonly called "dinks." If a lap becomes "dinked", it must be thrown away.

For many years, the industry has striven to provide a plastic lap to replace and avoid the problems associated with the use of aluminum laps, but without success—until now.

Attempts to provide a viable plastic lap have heretofore failed, principally for two reasons. First, while it is well known to use injection molding to produce easily machinable plastic parts, standard injection molding techniques do not produce an acceptably strong lap structure to withstand the mechanical stresses and abuses of the polishing process. This is because, ordinarily, injection molded plastic parts have only a relatively thin "skin" or "shell" of solid plastic to form the upper lap surface, and the structural integrity (such as it is) of the lap is provided by the standard "webbing" practice well known in the injection molding arts.

The other well known plastic molding process, compression molding, has proven unacceptable because the plastics which are utilizable in compression molding (i.e., thermal set plastics, such as phenolics) are generally brittle, and would crack or chip when attempting to machine them to required contour.

The present invention overcomes these problems and provides an acceptable plastic lap through a combination of a unique material selection and a molding process which departs substantially from the prevailing teachings ordinarily associated with injection molding. The particular material utilized is a mineral-filled thermoplastic polymer, which is injection molded to its final shape into a super-heated mold via an inlet valve or gate which is much, much larger than ordinarily necessary, and also utilizing process parameters that exceed the prevailing published process and design criteria for the material, and can only be accomplished by an injection molding press that is about three times the size and capacity that would ordinarily be called for to injection mold a part of the size and shape of standard optical laps.

SUMMARY AND OBJECTS OF THE PRESENT INVENTION

The primary object of the present invention is to provide a plastic lap which will provide the same utility as an aluminum lap, but without the attendant disadvantages of high weight and high machining cost.

It is an object of the present invention to provide an optical polishing lap which is substantially more easily machinable than an aluminum polishing lap without dinking, yet is mechanically serviceable to withstand the mechanical abuses of the polishing apparatus.

It is a further object to provide a polishing lap which is substantially reduced in cost compared to aluminum laps.

It is a further object to provide a polishing lap that is capable of multiple remachinings (sometimes referred to as "trueing").

It is a further object to provide a polishing lap which is so easily machinable that the number of pre-machined sizes can be, and is, startlingly reduced. At the present time, it is contemplated that, because the laps of the present invention are so easily and quickly machinable, the number of stock sizes provided will be four (4), compared to the 72 required be the present art. It is possible that the number of standard starter sizes provided will ultimately only be two (2).

Other objects and uses will become apparent to those skilled in the art, after review of the drawings and detailed description below, but such other objects and uses do not depart from the scope and spirit of the present invention.

BRIEF DESCRIPTION OF THE DRAWINGS

FIG. 5 is also provided with "double hatch lines" to reveal an alternate embodiment of the present invention, as described more fully below.

DETAILED DESCRIPTION OF THE PREFERRED EMBODIMENT (BEST MODE)

Figure 1:
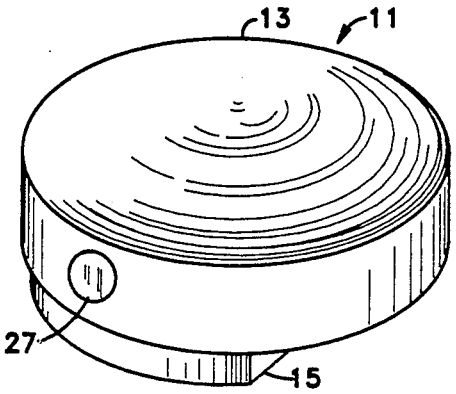
FIG. 1 is a top perspective view of an optical lap made according to the present invention.
Figure 2:
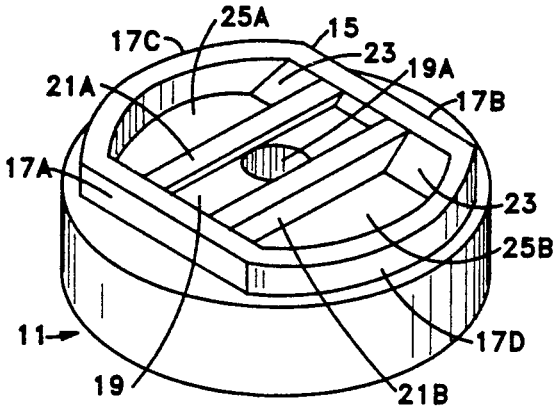
FIG. 2 is a bottom perspective view of an optical lap made according to the present invention.

Referring now to FIG. 1, disclosed is a generally round optical lap 11 of thermoplastic polymer (e.g, 6-6 nylon) comprising a monolithic dome shaped top portion 13 affixed to and upon a generally rectangular base 15.

Figure 3:
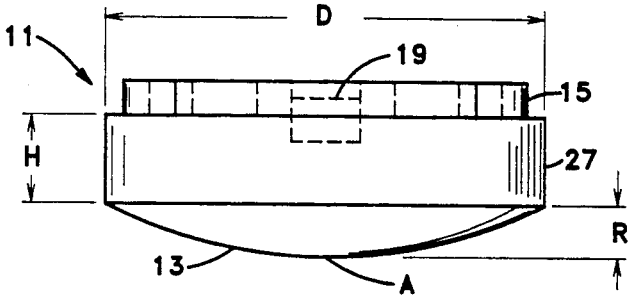
FIG. 3 is a front plan view of an optical lap made according to the present invention, with the device oriented domed surface down.
Figure 4:
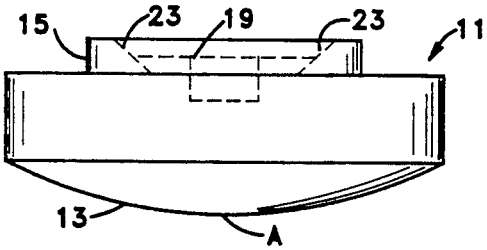
FIG. 4 is a right side plan view of an optical lap made according to the present invention, with the device oriented in the same fashion as in FIG. 3.
Figure 5:
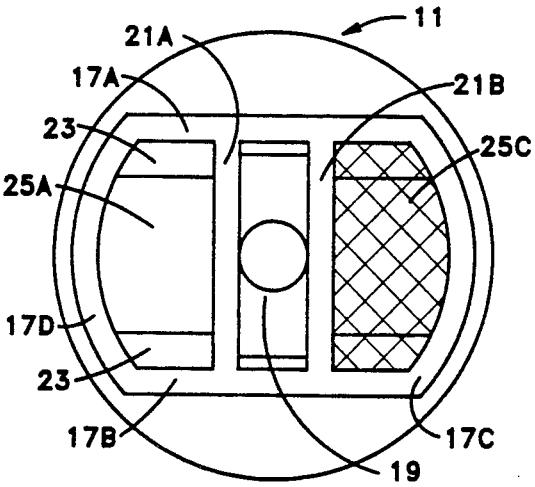
FIG. 5 is a bottom plan view of an optical lap made according to the present invention, with the device oriented in the same fashion as in FIGS. 3 and 4.

Referring to FIG. 3, the lap 11 is provided in circular form of a diameter D (e.g, 3.165") with cylindrical sides of a height H (e.g, 0.650"), or other shapes such as oblong (not shown) which are known in the optical grinding arts. Dome shaped portion 13 is provided with a rise R (e.g, an arc with a diameter of 3.50") extending from the upper end of sides H to the apex of the dome, indicated by point A. At present, D, H and R are provided in numerous varieties of dimensions known in the optical industry, and one of the principal benefits of the present invention is that the present invention can eliminate the high number of different dimensions available to four, or even possibly two.

Unlike most injection molded parts, the base 15 of the lap of the present invention is substantially integral, without the usual "webbing" pattern associated with injection molding techniques. Nevertheless, base 15 is provided with a space 19 in a manner to be adaptable to fit within the chuck of an optical lap cutter machine, such as one (Model 302) provided by Coburn Optical Industries of Muskogee Okla. Specifically, for the Coburn Model 302 lap cutter, there is provided a recess 19A to accommodate a protrusion on the chuck of the Model 302 Coburn optical lap cutter machine where the lap is held in place while cutting/grinding it to its necessary contour. Of course, the specific form of space 19/recess 19A is not integral to the invention, but is provided merely to accommodate the lap cutting geometry of the particular lap cutter described.

In the present design, base 15 is provided with parallel rails 17A and 17B which are provided to fit within the clamps of the chuck of the optical lap cutter. The end portions of the base 17C and 17D are provided in conformance with the general contour of the lap. As stated above, one object of the present invention is provide an integral base, rather than the usual webbed base associated with injection molding. In FIGS. 1-5, the base 15 is provided with only two cross webs 21A and 21B in addition to the four components, side rails 17A 17B and end rails 17C and 17D of the base 15. For a lap of the present invention, rails 17A and 17B are about 2.0" apart, and end rails 17C and 17D are provided with a curvature of about a 2.5" inside diameter.

It has been found that to avoid movement of the domed portion 13 imparted by the clamping pressure of the lap cutter chuck, it is advisable that side rails 17A and 17B are presented in sloped fashion 23 with the rails being thicker at the point where they contact the lower surface of dome 13 than they are at their terminal flat surfaces. The amount of slope 23 provided to rails 17A and 17B may vary substantially, such that the amount of open space 25A 25B will vary accordingly, and in fact spaces 25A and 25B may be completely filled, shown as double "hatch marks" 25C in the right portion of FIG. 5, thereby providing a virtually monolithic base except for the recess/space 19/19A necessary to permit the lap to placed upon a lap cutter.

To make the optical lap of the present invention, an injection molding process is used, which departs in several material respects from standard injection molding techniques. At present, the material which is known to work best for the present invention is a mineral filled thermoplastic polymer, namely 6/6 nylon with 40% talc filler; the particular brand which has demonstrated successful results is dupont's MINLON 10B40 nylon, although no particular reason is known why other thermoplastic polymers would not also provide adequate results.

The process utilized is beyond the published working ranges in three major respects. First, the thermoplastic polymer is heated above its published working range. Second, a substantially larger than ordinary "gate" size is used, about two to three times the size ordinarily used in "conventional" injection molding processes, to accommodate the rush of extraheated thermoplastic material into the mold cavity. Third, the mold itself is heated to a high degree to avoid the thermoplastic polymer establishing a "skin" or "shell" when first contacting the mold walls. Fourth, the molding pressures utilized are above the published working range. Because of these differences, it has been found that a surprisingly large injection molding machine is necessary to adequately accommodate this process and produce acceptable laps. When first confronted with the desired dimensions and expected volume of the lap (about 6 ounces), "conventional wisdom" in the injection molding arts predicted that the laps could be produced on a 100 ton injection machine, which is usually associated with a 6 ounce "shot" (i.e., the volume of the mold cavity to be filled). However, because of the substantial departures from "conventional wisdom", the laps of the present invention require an injection molding machine with a 300 ton capacity with an 18 ounce shot capacity. The particular injection molding machine utilized was manufactured by Reed Manufacturing Company (now no longer producing machines in its own name), but other injection molding suppliers could provide adequate substitutes.

The thermoplastic polymer is heated above its recommended temperature range, in the case of MINLON 10B40 to 610 degrees fahrenheit more or less, which is above the published working range of 520–580 degrees. Of course, care must be exercised to not overheat the polymer and destroy its as-molded properties, but the present upper limit of temperature beyond the published processing temperatures is unknown. By such raising the temperature of the thermoplastic polymer, it is possible to obtain higher working temperatures in the injection molding machine (e.g, a nozzle temperature of 560 degrees), which renders the thermoplastic polymer capable of more rapid flow into the mold cavity.

To facilitate the rapid injection of the high amount of polymer into the mold, it is necessary that a much larger than ordinary gate be used, depicted in the drawings at numeral 27. In making a three inch diameter round lap with a 3.5 inch diameter dome with sides H of about 0.650", and those of similar size, ordinarily a screw runner gate size of about 0.10"–0.15" would be called for, a ratio of gate size diameter to height H between about 0.154 to about 0.230. To make an acceptable lap of the present invention, a gate size of 0.250"–0.375" is used, a corresponding ratio of about 0.33 to 0.75, or some two to five times the ordinary gate size. This permits a sufficiently rapid flow of hot thermoplastic polymer into the mold to fill up the cavity before the thermoplastic begins to set.

The mold itself is made of steel, the usual material for an injection mold, and perhaps the "female" core portion of the mold is provided with copper or some other highly conductive metal. The mold is preferably maintained at a temperature around 200–210 degrees, which is almost twice as hot as the ordinary temperature (e.g, 120 degrees) called for by "conventional" injection molding proactices, also a substantial departure from the "conventional wisdom" of the injection molding art. Again, the elevated temperature of the heated mold restricts the skin forming tendencies of the thermoplastic polymer when it first contacts the mold walls.

The final departure from the "conventional wisdom" of the injection molding art is the use of higher molding pressures than the published working ranges. In making the laps of the present invention, a two stage pressing operation is used, the first stage at a pressure of 1200 pounds for about 36 seconds, and the second high pressure range for an additional 36 seconds at 1800 pounds pressure. This converts to a "high" pressure of about 15–25 percent above the published molding pressure ranges for mineral filled 6/6 nylon.

When completed, the laps of the present invention provide a dimensionally stable thermoplastic polymer which is remarkably easier to machine than an aluminum lap. For example, to grind or cut an aluminum lap, it usually requires three or more passes to finally grind the lap to its desired contour, a process which takes about 6–8 minutes. A thermoplastic optical lap made according to the present invention can machined in one pass on the same lap cutter, in about 45 seconds. The resulting finished thermoplastic lap will weigh about 6 ounces, compared to about 11 ounces for an aluminum lap. This substantial reduction in weight will no doubt prolong the bearing life of the polishing equipment, as well as the lap cutters themselves.

The foregoing description should be construed as limiting the scope of the invention herein disclosed in any fashion, as those skilled in the art will readily appreciate that the invention may practiced in many obvious variations, without departing from the scope or spirit of the invention.

I claim

1. An optical polishing lap comprising a thermoplastic polymer containing a particulate-mineral-reinforced polyamide resin of uniform density, porosity, and texture throughout including the surface of said lap, said lap, being of unitary construction formed having a solid main body with a generally domed-shaped upper head portion of substantially monolithic form providing an upper curved surface and a lower flat surface having an attachment means defining an integral base portion extending downward opposite said lower flat surface offset from said main body, said integral base portion having parallel side rail means having a straight outside wall and an angled inside wall sloped inwardly toward the center of said main body and toward one another providing a thicker rail at the intersection of said lower flat surface to provide additional structural strength and dimensional stability to said rails and said main body during use, end rail means conforming to the curvature of said main body for attaching said lap to a lap grinding machine, a lap cutter, or an optical polishing machine.

2. The invention of claim 1, including a centrally located recess within said integral base for positioning and attaching said lap to a lap cutter, lap grinder, or lap polisher.

3. The invention of claim 1, wherein said lap weighs less than 8 ounces.

4. The invention of claim 1, wherein said polyamide resin is augmented with 25 to 50 percent by weight of mineral filler.

5. The invention of claim 1, wherein said polyamide resin is nylon.

6. The invention of claim 4, wherein said mineral filler is talc.

7. An optical polishing lap comprising a mineral-filled thermoplastic polymer containing a particulate mineral-reinforced polyamide resin, said lap being of unitary construction having a solid, generally monolithic main body defining a generally domed-shaped upper head portion having an upper curved surface and a lower flat surface, said main body having an attachment means defining an integral base extending downwardly opposite said lower flat surface offset inwardly from said main body, said integral base having opposing end rail means, and opposing side rail means defining a straight outside wall and an angled inside wall sloped inwardly toward said lower flat surface of said main body and toward one another providing a thicker rail at the intersection of said lower flat surface for attaching said lap to a lap grinding machine, an optical polishing machine, or a lap cutter.

8. The invention of claim 7, wherein said end rail means conform to the curvature of said main body.

9. The invention of claim 7, including a centrally located recess within said integral base for positioning and attaching said lap to a lap cutter, lap grinder, or lap polisher.

10. The invention of claim 7, wherein said polyamide resin is augmented with 25 to 50 percent by weight of mineral filler.

11. The invention of claim 7, wherein said mineral filler is talc.

12. The invention of claim 7, wherein said polyamide resin is a nylon.

* * * * *